United States Patent [19]

Koch

[11] 4,452,283

[45] Jun. 5, 1984

[54] WEAVING REED HAVING A PLURALITY OF REED DENTS

[75] Inventor: Bernhard Koch, Horgenberg, Switzerland

[73] Assignee: Grob & Co. Aktiengesellschaft, Horgen, Switzerland

[21] Appl. No.: 426,655

[22] Filed: Sep. 29, 1982

[30] Foreign Application Priority Data

Mar. 31, 1982 [DE] Fed. Rep. of Germany ..... 3511996

[51] Int. Cl.[3] ..... D03D 49/62

[52] U.S. Cl. ..... 139/192; 28/212

[58] Field of Search ..... 139/188 R, 189, 191, 139/192; 28/212

[56] References Cited

U.S. PATENT DOCUMENTS 1,585,153 5/1926 Keller ..... 139/192

FOREIGN PATENT DOCUMENTS 6910894 7/1969 Fed. Rep. of Germany .

564283 1/1958 Netherlands .

1122265 8/1968 United Kingdom .

1188118 4/1970 United Kingdom ..... 139/192

*Primary Examiner*—Henry Jaudon

*Attorney, Agent, or Firm*—Watson, Cole, Grindle & Watson

[57] ABSTRACT

A weaving reed comprises a plurality of flat reed dents stacked side-by-side in a reed channel or container, each reed dent having opposed end sections terminating in side edges, one of such end sections of each reed dent having an outer edge thereof provided with an identification notch spaced from the side edge at that end section a distance corresponding to the thickness of a given reed dent, such that stacked reed dents of like thickness will have aligned identification notches, and stacked reed dents of unlike thickness will have staggered identification notches relative to the aligned notches. Reed dents of different thicknesses are therefore immediately distinguished and can be easily sorted out.

5 Claims, 3 Drawing Figures

Fig. 1
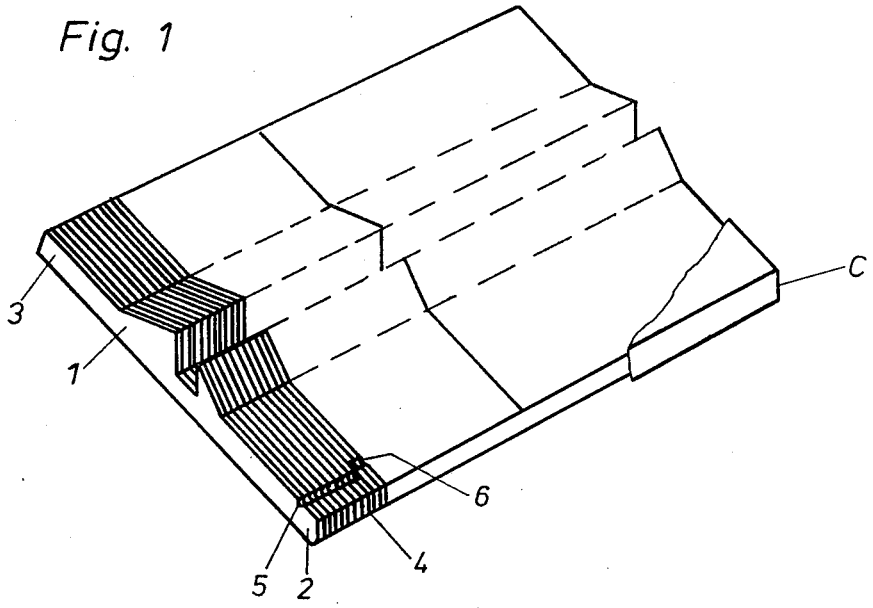
Fig. 2
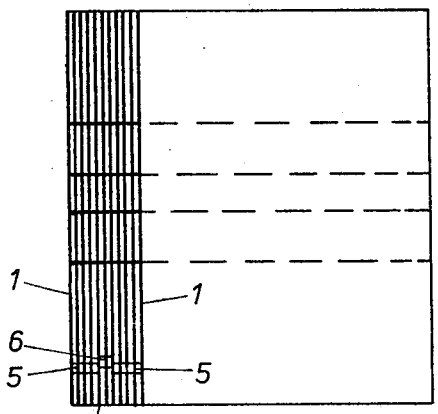
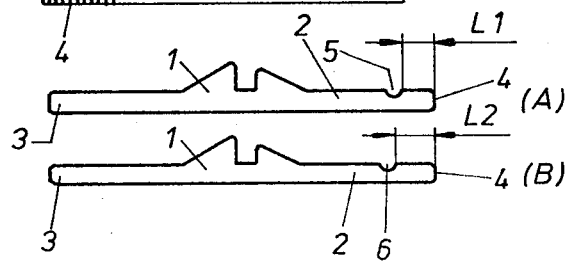
Fig. 3

WEAVING REED HAVING A PLURALITY OF REED DENTS

BACKGROUND OF THE INVENTION

This invention relates generally to a plurality of reed dents forming a weaving reed, the reed dents being arranged in flat, side-by-side relationship and each being of equal thickness.

In accordance with a known technique, a weaving reed may be formed of a plurality of reed dents which requires pressure coil springs arranged in a pair of reed channels, the reed dents spanning the channels and being inserted at their opposed ends between the windings of the springs so as to be arranged at equal distances from one another. The ends of the reed dents disposed within the spring coils are embedded in a hardenable material. A reed of this type can have several hundred reed dents each having the same thickness. However, if only one reed dent of a different thickness of material should be inadvertently included for a particular reed, it may produce a visible imperfection in the woven fabric. A reed having such a reed dent with a different thickness must therefore be rejected and be considered useless, since such an imperfection in the subsequent manufacturing process cannot be eliminated.

Certain fabrics and weaving processes requires reeds having different reed dents, but with each reed having reed dents of all the same thickness of material. Material thicknesses may differ by only less than one tenth of a millimeter. For example, in the manufacture of reed dents having a material thickness range between about 0.18 mm and about 0.7 mm, fourteen different gradations of material thicknesses are required. These comprise very small differences in thickness of material which differences are not discernible with the naked eye. After the reed dents are produced, ones having different material thicknesses may be inadvertently packaged together. Also, during the production of the reed dents, one could get stuck in a polishing tumbler which at the following operation with a new load of reed dents with a material thickness different from the one left in the tumbler, the latter will become mingled among the other dents and cannot thereafter be identified.

It is therefore essential that reed dents of one particular type be of equal material thickness taking into consideration that the reeds are usually manufactured at different factories. Thus, in a large quantity of reed dents each of a predetermined material thickness, reed dents of another material thickness accidentally intermingled therewith cannot be visually distinguished.

SUMMARY OF THE INVENTION

These drawbacks are substantially avoided by the present invention which provides an identification notch on an upper edge at one end section of each reed dent, the identification notch being spaced from an end edge at that end section a predetermined distance which is the same for the same material thickness of the reed dent. Thus, if reed dents of precisely the same shape and size are packed vertically side-by-side in a box, their notches will be in alignment and it will be possible to visually identify reed dents of different material thickness having differently spaced notches which will be staggers relative to the aligned notches.

The identification notch is disposed within the region of the end section of the reed dent so that it will lie within the reed channel and therefore the notch will become covered after the assembly of the reed dents into a weaving reed. The warp thread passing between two reed dents therefore avoids coming into contact with the notches, so that no damage to the warp ends will occur.

And, the identification notches according to the invention are arranged to function entirely differently from notches previously provided for anchoring the reed dent in the material filling the reed channel. Such notches are not for identification purposes and are located at both opposing end sections of the reed dent.

BRIEF DESCRIPTION OF THE DRAWINGS

FIG. 1 is a perspective view of a stack of reed dents arranged side-by-side;

FIG. 2 is a top view of a stack of reed dents; and

FIGS. 3A and 3B are side views of reed dents identified as having different thicknesses of material.

DETAILED DESCRIPTION OF THE INVENTION

Turning now to the drawings wherein like reference characters refer to like and corresponding parts throughout the several views, a plurality of the flat reed dents 1 are stacked upright side-by-side in, for example, a cardboard container C after the reed dents are processed. For clarity, the reed dents are shown in abutting relationship in FIGS. 1 and 2 as they would normally be disposed in the container.

Otherwise, the reed dents are mutually spaced apart equal distances by means of coil springs (not shown), as aforedescribed, and are based in a reed channel likewise illustrated as C. Each reed dent has opposing end sections 2 and 3 terminating in side edges 4. One of the end sections, such as 2, of each reed dent has an upper edge thereof provided with an identification notch 5 located a distance L1 (FIG. 3A) inwardly of side edge 4 at end section 2. This distance L1 is the same for a given thickness of material of each reed dent, such that notches 5 for reed dents of like thickness are shown in alignment in FIGS. 1 and 2. And, each reed dent having a thickness different from the reed dent thickness having an identification notch 5, is provided with an identification notch at its upper edge at end section 2 disposed at a different distance from side edge 4 thereat. For example, an identification notch 6 is provided at the upper edge of a pair of reed dents shown in FIGS. 1 and 2 with such pair each having a thickness different from the reed dents having notches 5 thereon. As shown in FIG. 3B, notches 6 are each spaced from adjacent side edge 4 a distance L2 which is greater than distance L1 at which notches 5 are spaced from side edge 4. Thus, in the stacked relationship of FIGS. 1 and 2, those reed dents having different thicknesses are provided with notches 6 which are staggered relative to the aligned notches 5, such that these dents of different thicknesses are immediately optically distinguishable and can be removed from the stack and discarded.

As mentioned above, the manufacturing process of reed dents normally covers some fourteen different thicknesses of material ranging from the finest at 0.18 mm to the coarsest at 0.7 mm. Obviously that these small differences in thickness cannot be visually distinguished. Thus, in order to accommodate on one of the end sections 2 and 3 of the reed dent the fourteen different identification marks associated with the different material thicknesses of reed dents, the individual length of each identification notch is about 1.5 mm and the staggering of the notches which identify the next size of material thickness is about 1.0 mm. Hence, it is possible to mark all fourteen different thickness of material for the purpose of identifying the corresponding reed dents. And, it is apparent that while manufacturing and subsequent packaging not all of the reed dents with different material thicknesses will be packed in the same container, so that it is more likely there are only a few number of reed dents having different material thicknesses that will be intermingled with the dents of equal thickness.

Also, it is possible to provide the aforedescribed identification notches not only on the upper edge of one of the end sections 2 and 3 of each reed dent, but also on the lower edge at one of these end sections since the stack of appropriately packed reed dents can also be turned.

Obviously, many modifications and variations of the present invention are made possible in the light of the above teachings. It is therefore to be understood that within the scope of the appended claims the invention may be practiced than otherwise than as specifically described.

What is claimed is:

1. A reed dent for the manufacture of a weaving reed having a plurality of flat reed dents of equal thickness, the reed dent having opposed end sections terminating in side edges for being held in a reed channel of the weaving reed, one of said end sections of the reed dent having an outer edge thereof provided with an identification notch, being spaced from said side edge at said one end section a distance corresponding to the thickness of said reed dent, whereby stacked reed dents of like thickness will have aligned identification notches.

2. The reed dent according to claim 1, wherein said identification notch is about 1.5 mm long.

3. A plurality of flat reed dents for the manufacture of several weaving reeds the reed dents of which having thicknesses respectively different from one another, each of said plurality of reed dents having opposed end sections terminating in side edges, an outer edge of one of said end section of each said reed dent having an identification notch therein spaced from each said side edge of said one end section a predetermined distance which is the same for the reed dents having the same predetermined thickness, the reed dents having thicknesses different from said predetermined thickness being provided with identification notches located from each said side edge of said one end section at distances different from said predetermined distance and corresponding to said different thicknesses, whereby reed dents of different thicknesses are visually distinguishable because of the staggered relationship of notches between them.

4. The plurality of reed dents according to claim 3, wherein the identification notches on reed dents of different thicknesses are staggered by at least 1 mm to each other.

5. A weaving reed comprising a plurality of flat reed dents stacked side-by-side at equal distances from one another in a reed channel of the weaving reed, each reed dent having opposed end sections terminating in side edges, one of said end sections of each said reed dent having an outer edge thereof provided with an identification notch, each said notch being spaced from said side edge at said one end section a distance corresponding to the thickness of said reed dents.

* * * * *